United States Patent [19]

Egenlauf

[11] 4,296,583

[45] Oct. 27, 1981

[54] SLAP TRIM INTERIOR MOLDING

[76] Inventor: Louis D. Egenlauf, 12634 Saginaw Ave., Chicago, Ill. 60633

[21] Appl. No.: 69,889

[22] Filed: Aug. 27, 1979

[51] Int. Cl.[3] ..... E04C 2/38

[52] U.S. Cl. ..... 52/717; 52/287

[58] Field of Search ..... 52/716–718, 52/287; 24/217 R

[56] References Cited

U.S. PATENT DOCUMENTS

| | | | |
|---|---|---|---|
| 2,487,571 | 11/1949 | Maxwell | 52/718 |
| 2,945,081 | 7/1960 | Bogese | 52/718 |
| 3,201,909 | 8/1965 | Grün | 52/717 |
| 3,246,440 | 4/1966 | Meyer | 52/718 |
| 3,335,429 | 8/1967 | Arp | 52/717 |
| 3,473,278 | 10/1969 | Gossen | 52/717 |
| 3,685,231 | 8/1972 | Blose | 52/716 |

FOREIGN PATENT DOCUMENTS

| | | | |
|---|---|---|---|
| 2237023 | 2/1975 | France | 52/716 |

*Primary Examiner*—Price C. Faw, Jr.
*Assistant Examiner*—Henry E. Raduazo

[57] ABSTRACT

An interior molding, for installation around window openings or doorways of a house; the device including a longitudinal, hollow, plastic extrusion that is attractively decorated on its front side, and which, on its rear, has a slot, so that the enlarged heads of a plurality of holding pins, driven stationarily in the wall, in spaced-apart relation along a straight row, can be snapped into the slot for holding the molding to the wall.

1 Claim, 5 Drawing Figures

10
11
11a
12
13
14
15
16
17
18
19
20
21
22
23
24
25
26
27
28
29
30
31
31a
32
33
34
35

SLAP TRIM INTERIOR MOLDING

This invention relates generally to building construction interior moldings.

It is well known, that the practice at this time for installation of interior moldings, in a house, is by nailing them permanently to a wall, so that in case of an extensive remodeling of a room, it is difficult to remove the molding without damage thereto, and to the wall.

Accordingly, it is a principal object of the present invention to provide a trim interior molding, that can be quickly and readily installed, by simply slapping it against the wall, so that it snap-fits on a row of holding pins provided there for it.

Another object is to provide a slap trim interior molding, that makes painting or wallpapering of a wall an easier task, as it eliminates the necessity of doing the work precisely to an edge of a permanent molding, in order that it does not look sloppy, so that the present invention permits a rough edge to be left on the work, that is thereafter covered by the molding, so as to make a perfect edge to the painting or wallpapering.

Other objects are to provide a slap trim interior molding, that is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4, 5:
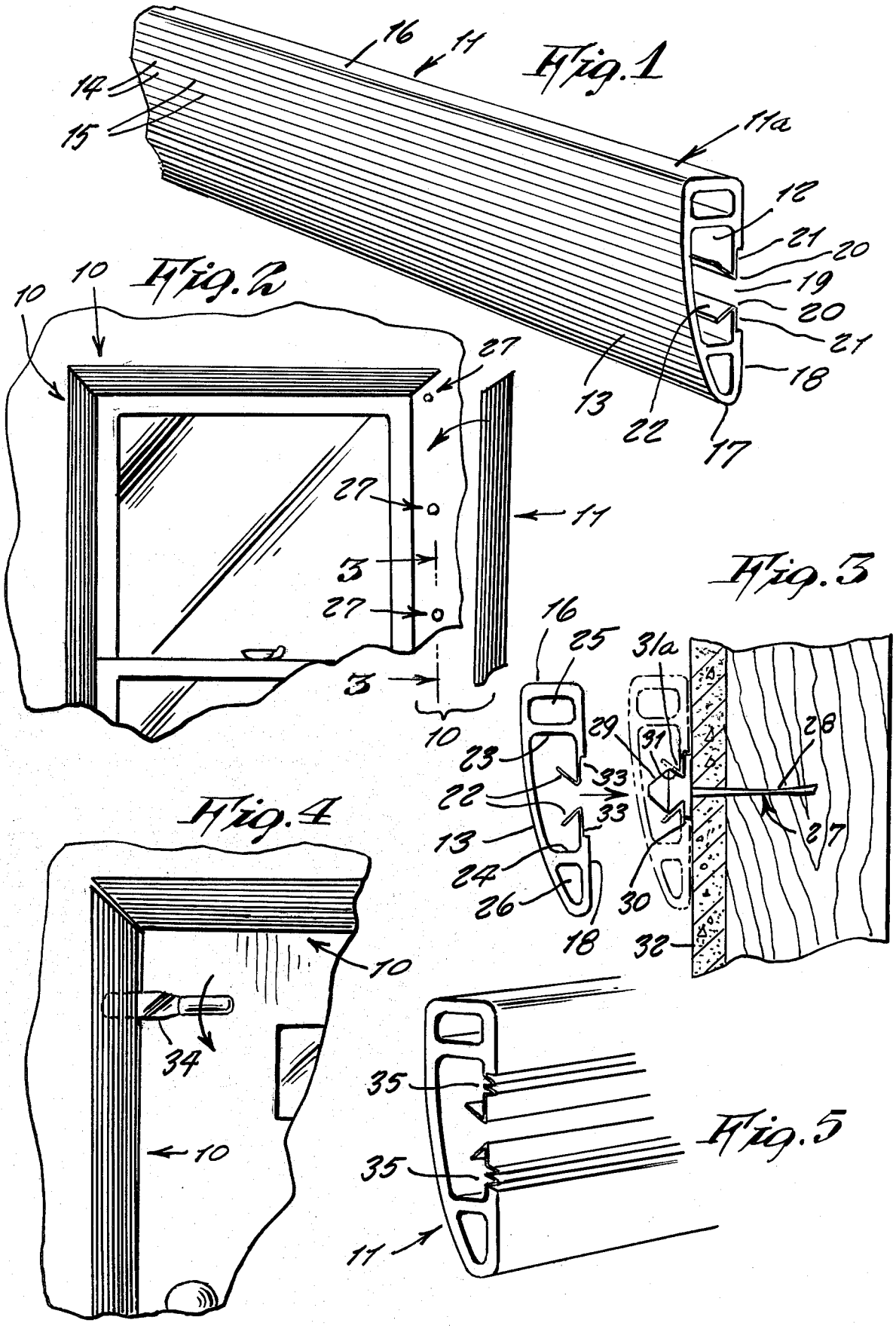
FIG. 1 is a perspective view, showing one end of a slap trim interior molding.
FIG. 2 is a front view of a window opening, showing the invention being installed therearound.
FIG. 3 is an enlarged cross-sectional view, taken on line 3—3 of FIG. 2, and showing how the slap trim molding is anchored on a holding pin.
FIG. 4 is a front view of a doorway opening, and showing the slap trim molding being snapped off from its holding pins, by means of using a putty knife.
FIG. 5 is a perspective view of another design of the invention, in which a rear slot will readily accommodate a row of holding pins, even if some of the pins are not precisely along the row.

Referring now to the drawing in greater detail, and more particularly, to FIGS. 1 through 4 thereof, at this time, the reference numeral 10 represents a slap trim interior molding, according to the present invention, wherein there is a one piece, elongated extrusion 11, that comprises a relatively thin shell 11*a*, around a hollow interior 12.

The shell includes a front wall 13, which may be made transversely arcuate, as shown, or any other desired configuration. A front side thereof is decoratively ribbed, with elongated ribs 14 between shallow grooves 15. One side edge of the extrusion may include a narrow, flat edge wall 16, while an opposite edge 17 is simply rounded.

A generally flat rear wall 18 is intercepted, along its center, by a longitudinally extending slot 19. The rear wall portions, adjacent the edge 20 of the slot, are made thin-walled, as shown at 21, in order to be flexible. An angularly inward extending flange 22, from each edge 20 of the slot, is also made thin-walled, so as, likewise, to be flexible.

A remainder of the shell is made thicker, so as not to be flexible. It also includes a pair of transverse partitions 23 and 24, between the front and rear walls, so as to produce tubular chambers 25 and 26, along each opposite side edge of the extrusion.

The present invention also includes a plurality of specially shaped holding pins 27, for association with the plastic extrusion, and which serve to hold the extrusion to the wall. Each holding pin is forged, or stamped out of steel, and includes an elonged shank 28, having a one-half twist along its length toward a flattened tip. A head 29, on one end of the shank, includes flattened transverse shoulder 30, perpendicular to the shank, and angular faces 31 adjacent thereto, so as to form an angular groove 31*a* therebetween. The angle between faces 31 is the same as the angle between the flanges 22.

In use, the holding pins are driven up to their shoulders into the wall 32, approximately twelve to sixteen inches apart, along a straight row. The extrusion is then simply slapped thereagainst, so that the holding pins snap into the slot 19. The shoulders fit into a recess 33, formed on an outer side of the extrusion rear wall, due to the thin-walled portions 21.

To remove the extrusion, a putty knife 34 is simply slid between the extrusion and wall surface, and is then given a short twist, so that the extrusion snaps off the holding pin heads.

In a modified construction, shown in FIG. 5, a few thin-walled accordian pleats 35 are between the thin-walled and thicker-walled portions of the rear wall. The pleats allow the slot 19 to be deflected to either side from a straight line, in case any holding pins are not mounted accurately along a straight line on the wall.

While various changes may be made in the detail construction, it is understood that such changes will be within the spirit and scope of the present invention, as is defined by the appended claims.

What I now claim is:

1. A slap trim interior molding, comprising, in combination, an elongated plastic extrusion and a plurality of separate holding pins for holding said extrusion against a room wall; said extrusion comprising a hollow shell having an elongated, decorative-shaped, front wall, and a rear wall intercepted along its longitudinal center by an elongated, straight slot; each said holding pin including an enlarged head having a groove on its opposite sides, for elongated edges of said extrusion rear wall along said slot to snap-fit therein; a portion of said rear wall adjacent each said slot edge being thin-walled respective to a remaining thicker-walled portion of said rear wall, and an angularly inclined flange extending inwardly into said shell from each said slot edge, and a plurality of longitudinally extending, thin-walled accordian pleats are formed between each said thin-walled portion and said thicker-walled portion of said rear wall, for flexing of any portion of said slot edges in a transverse direction either toward or away from each other.

* * * * *